US009312650B1

(12) United States Patent
Chen

(10) Patent No.: US 9,312,650 B1
(45) Date of Patent: Apr. 12, 2016

(54) PLUG CONNECTOR, RECEPTACLE CONNECTOR AND ELECTRICAL CONNECTOR ASSEMBLY

(71) Applicant: OUPIIN ELECTRONIC (KUNSHAN) CO., LTD, Kunshan (CN)

(72) Inventor: Hsin Chih Chen, Kunshan (CN)

(73) Assignee: OUPIIN ELECTRONIC (KUNSHAN) CO., LTD, Kunshan (CN)

( * ) Notice: Subject to any disclaimer, the term of this patent is extended or adjusted under 35 U.S.C. 154(b) by 0 days.

(21) Appl. No.: 14/680,493

(22) Filed: Apr. 7, 2015

(30) Foreign Application Priority Data

Oct. 21, 2014 (CN) ..... 2014 1 0559105
Oct. 21, 2014 (CN) ..... 2014 2 0606634 U

(51) Int. Cl.

| | |
|---|---|
| ***H01R 12/00*** | (2006.01) |
| ***H01R 24/68*** | (2011.01) |
| ***H01R 24/60*** | (2011.01) |
| ***H01R 13/46*** | (2006.01) |
| *H01R 107/00* | (2006.01) |

(52) U.S. Cl.
CPC ..... *H01R 24/68* (2013.01); *H01R 13/46* (2013.01); *H01R 24/60* (2013.01); *H01R 2107/00* (2013.01)

(58) Field of Classification Search
None
See application file for complete search history.

(56) References Cited

U.S. PATENT DOCUMENTS

| | | | | |
|---|---|---|---|---|
| 6,319,075 | B1 | 11/2001 | Clark et al. | |
| 7,402,064 | B2 * | 7/2008 | Daily | H01R 13/113 439/290 |
| 8,435,043 | B2 * | 5/2013 | Yu | H01R 12/7088 439/65 |
| 8,662,923 | B2 * | 3/2014 | Wu | H01R 12/58 439/595 |
| 8,968,009 | B2 * | 3/2015 | Chen | H01R 12/7088 439/79 |
| 9,153,887 | B2 * | 10/2015 | Chen | H01R 12/7088 |

* cited by examiner

*Primary Examiner* — Xuong Chung Trans
(74) *Attorney, Agent, or Firm* — Osha Liang LLP

(57) ABSTRACT

A plug connector, a receptacle connector and an electrical connector assembly are disclosed. When the plug connector is engaged with the receptacle connector, the power mating bodies and the signal mating body of the receptacle connector respectively enter into the corresponding plug power ports and the plug signal port of the plug connector, and the plug power contacts and the plug signal contacts respectively enter into the receptacle power ports and the receptacle signal ports. The vertical blade-shaped mating end of the plug power contact is inserted between the elastic pieces of the corresponding two receptacle power contacts, and the head of the plug signal contact is inserted into the forked head of the corresponding receptacle signal contact.

10 Claims, 9 Drawing Sheets

PLUG CONNECTOR, RECEPTACLE CONNECTOR AND ELECTRICAL CONNECTOR ASSEMBLY

BACKGROUND OF THE INVENTION

1. Field of the Invention

The present invention relates to a connector technology, and more particularly to a horizontal plug connector, a horizontal receptacle connector and an assembly of the plug connector and the receptacle connector.

2. Description of the Prior Art

At present, the power function and the signal function are constructed in an electrical connector, but this electrical connector is usually low and hybrid. This electrical connector occupies the small height space, but occupies too much edge space of a circuit board along a length direction thereof. Because the edge space of the circuit board is limited, other electrical connectors can not be further mounted on the edge of the circuit board. For example, U.S. Pat. No. 6,319,075 discloses an electrical connector, in which a power module and a signal module are arranged side by side. Further, the power module has a large width size. So, the low type hybrid electric connector can only be suitable for an electrical device, which need a small height, and unsuitable for an electrical equipment, which need add other components onto the edge of the circuit board.

Hence, it is needed to provide a new connector, which can provide the power transmission function and the signal transmission function, has an optimized structure, and integrates the power module and the signal module together by a new mode, for satisfying the different requirements of the electrical equipments.

BRIEF SUMMARY OF THE INVENTION

One object of the present invention is to provide a plug connector, in which plug power contacts and plug signal contacts are compactly arranged to save the edge space of a circuit board, and the plug power contacts are mounted in a plug housing according to a special arrangement.

Another object of the present invention is to provide a receptacle connector, in which receptacle power contacts and receptacle signal contacts are compactly arranged for saving the edge space of a circuit board, and the receptacle power contacts are mounted in a receptacle power housing according to a special arrangement.

Further object of the present invention is to provide an electrical connector assembly including a plug connector and a receptacle connector, which can be stably connected for ensuring the power and signal transmission performance of the both.

To achieve the aforementioned objects or other objects of the present invention, the present invention adopts the following technical solution.

The present invention provides a plug connector, which comprises a plug housing, a plug retaining seat, a row of plug power contacts and a row of plug signal contacts. The plug housing has a mating portion located on the front of the plug housing and a mounting portion located on the rear thereof. A front surface of the mating portion is perpendicular to a bottom surface of the mounting portion. A front surface of the mating portion forms a row of parallel vertical plug power ports and one plug signal port located under the row of the plug power ports to form a stacked structure. The row of the plug power ports includes at least one first plug power port and at least one second plug power port. The first plug power port forms a vertical middle plate therein. The plug signal port has an open bottom and has a top wall and two opposite sidewalls. The mounting portion forms a row of plug power contact-mounting cavities that include at least one first plug power contact-mounting cavity and at least one second plug power contact-mounting cavity. Each of the plug power contact-mounting cavities forms two plug power contact-receiving passages that pass through a rear surface and the bottom surface of the mounting portion to receive and fix the plug power contacts. The plug power contact-receiving passages located in the first and second plug power contact-mounting cavity are respectively communicated with the first and second plug power ports. The mounting portion further forms a row of plug signal contact-receiving passages that are located on the bottom surface of the mounting portion and communicated with the plug signal port to receive the corresponding plug signal contacts. The plug retaining seat is drawer-shaped and has a bottom board, two opposite side boards and a rear board. The plug retaining seat is mounted on the mating portion of the plug housing to close the open bottom of the plug signal port and fix the plug signal contacts. Each two adjacent plug power contacts have symmetrical structures and form a group. Each group is fixed in one plug power contact-mounting cavity, and each plug power contact is fixed in the corresponding plug power contact-receiving passage. Each of the plug power contacts includes an L-type connecting portion being vertical and blade-shaped, a vertical blade-shaped mating end being bent toward one side from a front end of the connecting portion and then horizontally extending forward, and a back end vertically extending downward from a bottom end of the connecting portion. Wherein the mating end passes through the corresponding plug power contact-receiving passage to enter into the corresponding plug power port, the connecting portion is fixed in the plug power contact-receiving passage, and the back end extends out of the bottom surface of the mounting portion. Each of the plug signal contacts includes a head horizontally extending forward, a tail being perpendicular to the head and vertically extending downward, and an L type retaining portion connecting the head and the tail. Wherein the head is inserted into the plug signal port, one portion of the L type retaining portion is fixed in the plug signal contact-receiving passage, the other portion thereof is fixed in the plug retaining seat, and the tail extends out of the bottom surface of the mounting portion.

In one embodiment, the row of the plug power ports includes two first plug power ports and one second plug power port, the width of the first plug power port is larger than that of the second plug power port, the two first plug power ports are symmetrically located at two sides of the second plug power port, the row of the plug power contact-mounting cavities includes two first plug power contact-mounting cavities and one second plug power contact-mounting cavity, the width of the first plug power contact-mounting cavity is larger than that of the second plug power contact-mounting cavity, and the two first plug power contact-mounting cavities are symmetrically located at two sides of the second plug power contact-mounting cavity.

In one embodiment, the distance between two plug power contact-receiving passages located in the first plug power contact-mounting cavity is larger than that between other two plug power contact-receiving passages located in the second plug power contact-mounting cavity, two mating ends of the plug power contacts located in the first plug power contact-mounting cavity respectively pass through the corresponding plug power contact-receiving passages to enter into the first plug power port and be respectively located close to two sides of the middle plate, and two mating ends of the plug power contacts located in the second plug power contact-mounting cavity respectively pass through the corresponding plug power contact-receiving passages to enter into the second plug power port and be tightly close to each other.

In one embodiment, each of the two sidewalls of the plug signal port forms a groove and a protrusion, an outside surface of each side board of the plug retaining seat has a rib corresponding to the groove, and each side board also has a notch corresponding to the protrusion.

In one embodiment, the rear board of the plug retaining seat forms a row of through holes passing through a front and rear surfaces thereof, the retaining portion of the plug signal contact has a horizontal width portion in a horizontal direction and a vertical width portion in a vertical direction, the head of the plug signal contact passes through the through hole of the plug retaining seat and is inserted into the plug signal port, the horizontal width portion is fixed in the through hole, and the vertical width portion is fixed in the plug signal contact-receiving passage.

The present invention also provides a receptacle connector, which comprises a receptacle power housing, a receptacle signal housing, a row of receptacle power contacts and a row of receptacle signal contacts. The receptacle power housing includes a power base and a row of parallel vertical power mating bodies. The power mating bodies are located in parallel and protrude forward from a front surface of the power base to form a row of vertical receptacle power ports. The row of the receptacle power ports includes at least one first receptacle power port and at least one second receptacle power port. A rear surface of the power base forms a row of receptacle power contact-mounting cavities including at least one first receptacle power contact-mounting cavity and at least one second power contact-mounting cavity. Each of the receptacle power contact-mounting cavities forms two receptacle power contact-receiving passages that pass through the rear surface and a bottom surface of the power base to receive and fix the corresponding receptacle power contacts. The power base forms a concave space on the bottom surface thereof. The concave space has a top wall, a rear wall and two opposite side walls. The rear wall forms a row of receptacle signal contact-receiving passages passing through the bottom surface of the power base to receive and fixing the receptacle signal contacts. The receptacle signal housing includes a flat signal base and a flat horizontal signal mating body. The signal mating body horizontally protrudes forward from a front surface of the signal base. The signal base is embedded into the concave space of the power base. The signal mating body is located under the power mating bodies. The signal base forms a row of signal holes to receive the receptacle signal contacts. A front surface of the signal mating body forms a row of receptacle signal ports that extend backward to the signal base and are respectively communicated with the corresponding signal holes. Each two adjacent receptacle power contacts have symmetrical structures and form a group. Each group is fixed in one receptacle power contact-mounting cavity, and each receptacle power contact is mounted in the corresponding receptacle power contact-receiving passage. Each receptacle power contact includes an L type vertical plate, at least one elastic piece being bent from a front edge of the vertical plate and extending forward, and a tail portion vertically extending downward from a bottom edge of the vertical plate. The vertical plate is fixed in the corresponding receptacle power contact-receiving passage, the elastic piece is inserted into the corresponding receptacle power port, and the tail portion extends out of the bottom surface of the power base. Each receptacle signal contact includes a horizontal plate, a forked head horizontally extending forward from a front edge of the horizontal plate, and a tail end being bent downward from a rear edge of the horizontal plate. The horizontal plate is fixed in the corresponding signal hole, the forked head enters into the corresponding receptacle signal port, and the tail end extends along the corresponding receptacle signal contact-receiving passage and extends out of the bottom surface of the power base.

In one embodiment, the row of the receptacle power ports includes two first receptacle power ports and one second receptacle power port, the width of the first receptacle power port is larger than that of the second receptacle power port, the two first receptacle power ports are symmetrically located at two sides of the second receptacle power port; the row of the receptacle power contact-mounting cavities includes two first receptacle power contact-mounting cavities and one second receptacle power contact-mounting cavity, the width of the first receptacle power contact-mounting cavity is larger than that of the second receptacle power contact-mounting cavity, and the two first receptacle power contact-mounting cavities are symmetrically located at two sides of the second receptacle power contact-mounting cavity; the distance between two receptacle power contact-receiving passages located in the first receptacle power contact-mounting cavity is larger than that between other two receptacle power contact-receiving passages located in the second receptacle power contact-mounting cavity.

In one embodiment, the elastic pieces of two receptacle power contacts in each group pass through the corresponding receptacle power contact-receiving passages to enter into one corresponding receptacle power port and respectively close to a left and right inner sidewalls of the receptacle power port.

In one embodiment, each side wall of the concave space forms a slot and a convex block, each of two opposite side surfaces of the signal base forms a flange corresponding to the slot and a recess corresponding to the convex block.

The present invention further provides an electrical connector assembly, comprising a plug connector and a receptacle connector. When the plug connector is engaged with the receptacle connector, the power mating bodies and the signal mating body of the receptacle connector respectively enter into the corresponding plug power ports and the plug signal port of the plug connector, the plug power contacts and the plug signal contacts respectively enter into the receptacle power ports and the receptacle signal ports. The vertical blade-shaped mating end of the plug power contact is inserted between the elastic pieces of the corresponding two receptacle power contacts, and the head of the plug signal contact is inserted into the forked head of the corresponding receptacle signal contact.

In comparison with the prior art, the plug connector, the receptacle connector and the electrical connector assembly according to the present invention can construct a compact structure by stacking the signal ports and the power ports, thereby saving the edge space of a circuit board and being capable of disposing more other type connectors on the edge of the circuit board. Moreover, the plug power contacts and the receptacle power contacts are respectively mounted in the plug housing and the receptacle power housing according to a special arrangement.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "top", "bottom", "front", "back", "left", "right", "top", "bottom" etc., are only used with reference to the orientation of the accompanying drawings. Therefore, the used directional terms are intended to illustrate, but not to limit, the present invention.

Figure 1:
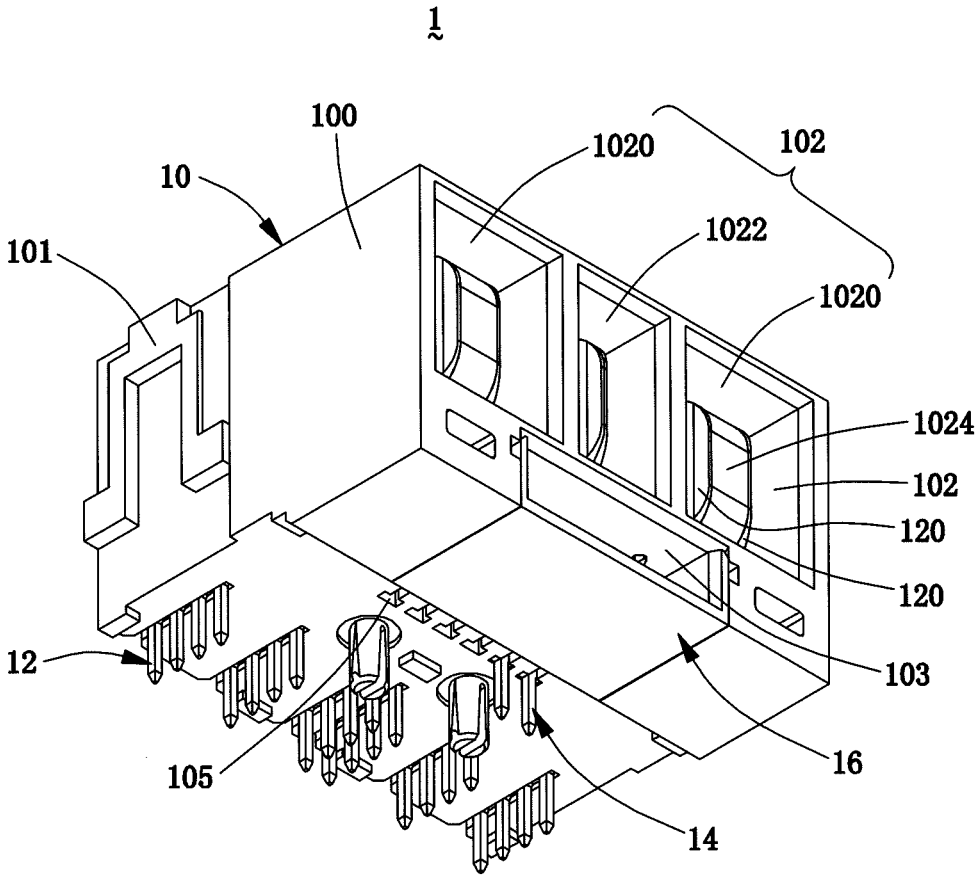
FIG. 1 is a perspective schematic view of a plug connector of the present invention.
Figure 2:
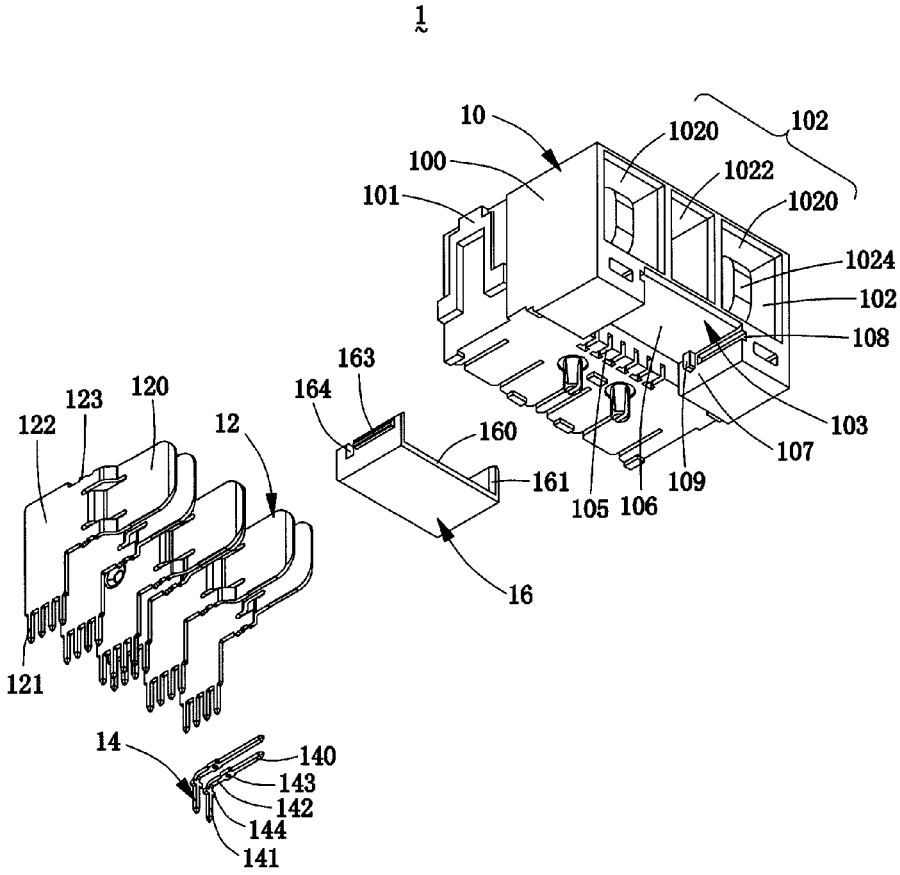
FIG. 2 is an exploded view of the plug connector shown in FIG. 1.
Figure 3:
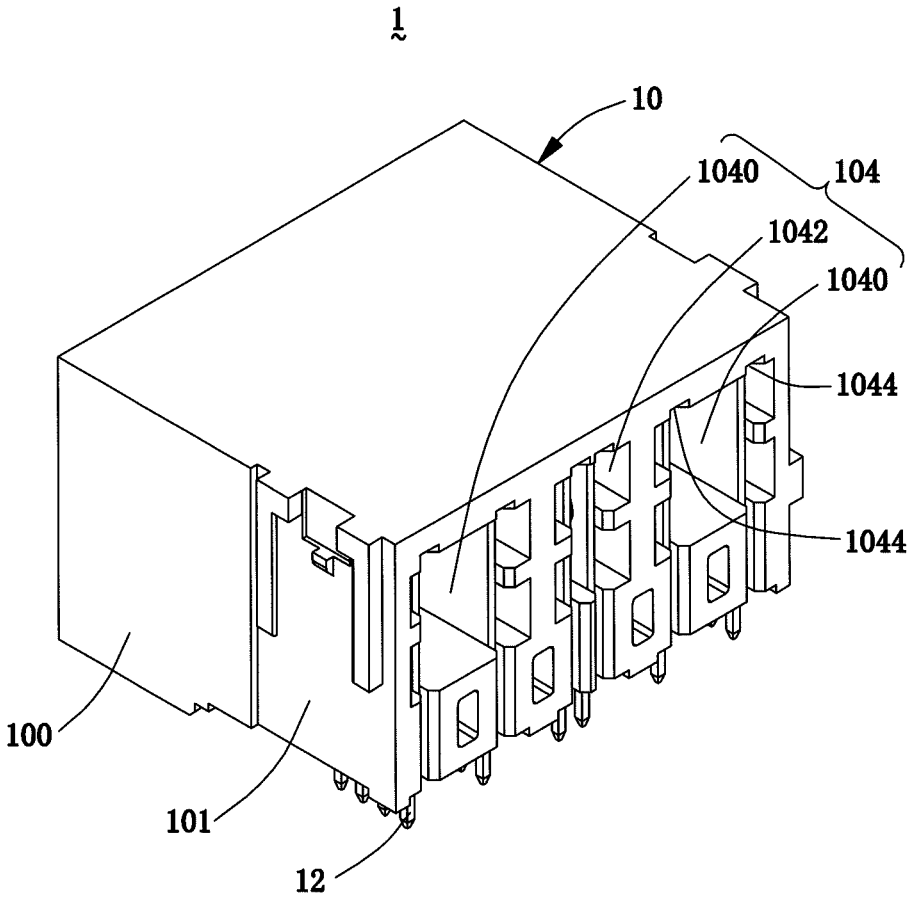
FIG. 3 is a perspective schematic view of the plug connector of the present invention along another direction.
Figure 4:
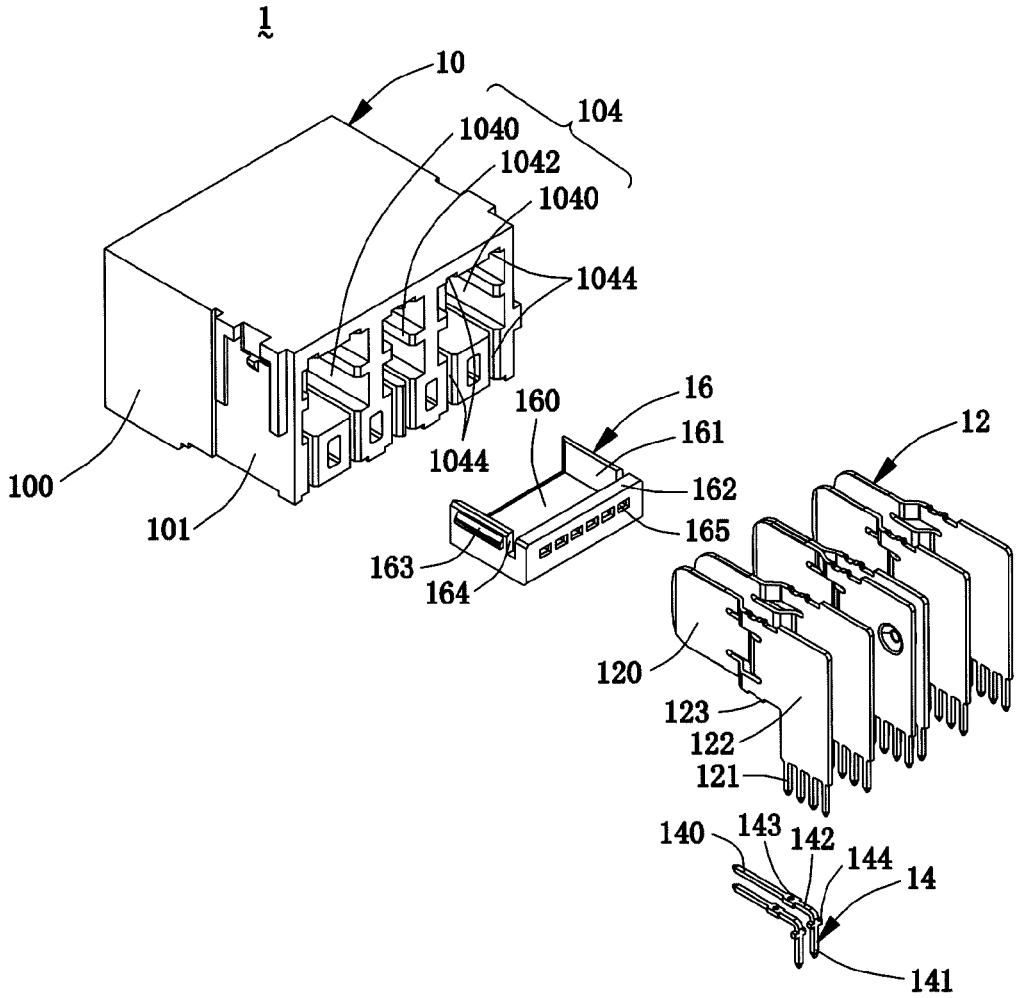
FIG. 4 is an exploded view of the plug connector shown in FIG. 3.

Please refer to FIGS. 1 to 4, FIG. 1 is a perspective schematic view of a plug connector 1 of the present invention, FIG. 2 is an exploded view of the plug connector 1 shown in FIG. 1, FIG. 3 is a perspective schematic view of the plug connector 1 of the present invention along another direction, and FIG. 4 is an exploded view of the plug connector 1 shown in FIG. 3.

Figure 9:
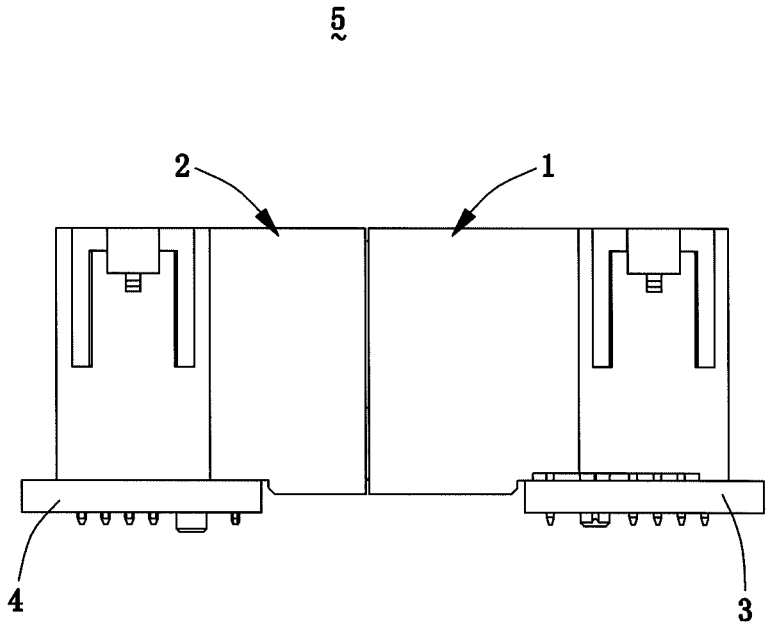
FIG. 9 is a plan view of an electrical connector assembly mounted on two circuit boards.

Please refer to FIGS. 1 to 4, the plug connector 1 of the present invention is a horizontal connector, the mating direction of which is parallel to a first circuit board 3 (as shown by FIG. 9). The plug connector 1 has hybrid ports and can provide the power and signal transmission functions. The plug connector 1 includes a plug housing 10, a row of plug power contacts 12, a row of plug signal contacts 14 and a plug retaining seat 16.

Please refer to FIGS. 1 to 4, the plug housing 10 has a mating portion 100 located on the front thereof and a mounting portion 101 located on the rear thereof. A front surface of the mating portion 100 is perpendicular to a bottom surface of the mounting portion 101, and a bottom of the mating portion 100 is open.

As shown in FIGS. 1 and 2, the front surface of the mating portion 100 forms a row of vertical plug power ports 102 and one plug signal port 103 located under the row of the plug power ports 102. The plug signal port 103 has an open bottom. The row of the plug power ports 102 and the plug signal port 103 extend backward to the mounting portion 101. The plug signal port 103 and the row of the plug power ports 102 form a stacked structure.

In the embodiment, the plug power ports 102 have different structures. The plug power ports 102 include a first plug power port 1020 and a second plug power port 1022. The width of the first plug power port 1020 is larger than that of the second plug power port 1022. The first plug power port 1020 forms a vertical middle plate 1024. In other embodiments, the widths of the above plug power ports 102 may be adjusted according to the wiring of the circuit boards. For example, the width of the first plug power port 1020 may be less than or equal to that of the second plug power port 1022.

In the embodiment, the number of the plug power ports 102 is three, including two first plug power ports 1020 and one second plug power port 1022. The two first plug power ports 1020 are symmetrically located at two sides of the second plug power port 1022. Moreover, the plug signal port 103 is located under the three plug power ports 102. Of course, the number of the plug power ports 102 cannot be used to limit the protection scope of the present invention.

Please refer to FIGS. 3 and 4, the mounting portion 101 forms a row of plug power contact-mounting cavities 104, including a first plug power contact-mounting cavity 1040 and a second plug power contact-mounting cavity 1042. The width of the first plug power contact-mounting cavity 1040 is larger than that of the second plug power contact-mounting cavity 1042. In the embodiment, two first plug power contact-mounting cavities 1040 are symmetrically located at two sides of the second plug power contact-mounting cavity 1042. Each of the plug power contact-mounting cavities 104 forms two plug power contact-receiving passages 1044, which pass through a rear surface and the bottom surface of the mounting portion 101 to receive and fix the plug power contacts 12. The plug power contact-receiving passages 1044 located in the first plug power contact-mounting cavities 1040 and the second plug power contact-mounting cavity 1042 are respectively communicated with the first plug power ports 1020 and the second plug power port 1022.

Moreover, the distance between the two plug power contact-receiving passages 1044 in the first plug power contact-mounting cavity 1040 is larger than that between other two plug power contact-receiving passages 1044 in the second plug power contact-mounting cavity 1042. In other embodiments, the distance between two plug power contact-receiving passages 1044 can be adjusted according to the wiring of the circuit boards.

Please refer to FIGS. 1 and 2, the mounting portion 101 further forms a row of plug signal contact-receiving passages 105, which are located on the bottom surface thereof and are communicated with plug signal port 103 for receiving the plug signal contacts 14.

In the embodiment, the number of the plug power contact-receiving passages 1044 are six, and the number of the plug signal contact-receiving passages 105 is six. Of course, the number of the plug power contact-receiving passages 1044 and the plug signal contact-receiving passages 105 cannot be used to limit the protection scope of the present invention.

As shown in FIG. 2, the bottom of the plug signal port 103 of the plug housing 10 is open. Specifically, the plug signal port 103 has a top wall 106 and two opposite sidewalls 107, but no the bottom. Each of the two sidewalls 107 forms a groove 108 and a protrusion 109.

Please refer to FIGS. 2 and 4, the plug retaining seat 16 is drawer-shaped, and mounted on the bottom of the mating portion 100 of the plug housing 10 to close the open bottom of the plug signal port 103 and fix the plug signal contacts 14. Specifically, the plug retaining seat 16 has a bottom board 160, two opposite side boards 161 and a rear board 162. An outside surface of each side board 161 has a rib 163 corresponding to the groove 108 of the plug housing 10, and each side board 161 also has a notch 164 corresponding to the protrusion 109 of the plug housing 10. The rear board 162 forms a row of through holes 165, which pass through a front and rear surfaces thereof, for being used to receive and secure the plug signal contacts 14. When the plug retaining seat 16 is mounted on the plug housing 10, the bottom board 160 closes the open bottom of the plug signal port 103, the rib 163 of the side board 161 enters into the corresponding groove 108 of the plug housing 10, and the protrusion 109 of the plug housing 10 is embedded into the corresponding notch 164 of the side board 161. Now, the rear board 162 of the plug retaining seat 16 is located at the plug signal contact-receiving passages 105 of the mounting portion 101 to fix the plug signal contacts 14.

Please refer to FIGS. 2 and 4, the row of the plug power contacts 12 includes six plug power contacts 12. Each two adjacent plug power contacts 12 have symmetrical structures and form a group. Each group is fixed in one plug power contact-mounting cavity 104, and each plug power contact 12 is fixed in the corresponding plug power contact-receiving passage 1044. The plug power contact 12 includes an L-type connecting portion 122, a vertical blade-shaped mating end 120, and a back end 121. The connecting portion 122 is vertical blade-shaped, the mating end 120 is bent toward one side from a front end of the connecting portion 122 and then horizontally extends forward, and the back end 121 vertically extends downward from a bottom end of the connecting portion 122. In the embodiment, the back end 121 of the plug power contact 12 consists of a plurality of pins. An upper edge and a lower edge of the connecting portion 122 are formed with barbs 123.

Please refer to FIGS. 1 and 4, when the plug power contacts 12 are mounted on the plug housing 10, the mating end 120 of each plug power contact 12 passes through the corresponding plug power contact-receiving passage 1044 to enter into the plug power port 102 of the plug housing 10, the connecting portion 122 is fixed in the plug power contact-receiving passage 1044 by the barbs 123, and the back end 121 extends out of the bottom surface of the mounting portion 101 for preparing to be connected with power points of the first circuit board 3. More specifically, two mating ends 120 of one group of the plug power contacts 12 located in the first plug power contact-mounting cavity 1040 respectively pass through the corresponding plug power contact-receiving passages 1044 to enter into the first plug power port 1020 and be respectively located close to two sides of the middle plate 1024. And, two mating ends 120 of the other group of the plug power contacts 12 located in the second plug power contact-mounting cavity 1042 respectively pass through the corresponding plug power contact-receiving passages 1044 to enter into the second plug power port 1022 and be tightly close to each other.

Please refer to FIGS. 2 and 4, the row of the plug signal contacts 14 includes two plug signal contacts 14, each of which is mounted in the corresponding plug signal contact-receiving passage 105 of the plug housing 10. The plug signal contact 14 includes a head 140 horizontally extending forward, a tail 141 being perpendicular to the head 140 and vertically extending downward, and an L type retaining portion 142 connecting the head 140 and the tail 141. The retaining portion 142 has a horizontal width portion 143 in a horizontal direction and a vertical width portion 144 in a vertical direction. In assembly, the head 140 of the plug signal contact 14 is inserted into the through hole 165 of the plug retaining seat 16, the horizontal width portion 143 is fixed in the through hole 165, therefore the plug signal contact 14 and the plug retaining seat 16 are together mounted on the plug housing 10. The vertical width portion 144 of the plug signal contact 14 may enter from the bottom surface of the mounting portion 101 to be fixed in the plug signal contact-receiving passage 105, and the tail 141 can extend out of the bottom surface of the mounting portion 101.

In the embodiment, the plug connector 1 of the present invention includes two plug signal contacts 14. Of course, the number of the plug signal contacts 14 can be adjusted according to the need, so the protection scope of the present invention can not be limited by the number of the plug signal contacts 14.

Please refer to FIGS. 5 to 8, the receptacle connector 2 of the present invention is a horizontal connector, the mating direction of which is parallel to a second circuit board 4 (as shown in FIG. 9). The receptacle connector 2 has hybrid ports and can provide the power and signal transmission functions. The receptacle connector 2 includes a receptacle power housing 20, a row of receptacle power contacts 22, a row of receptacle signal contacts 24, and a receptacle signal housing 26.

Figure 6:
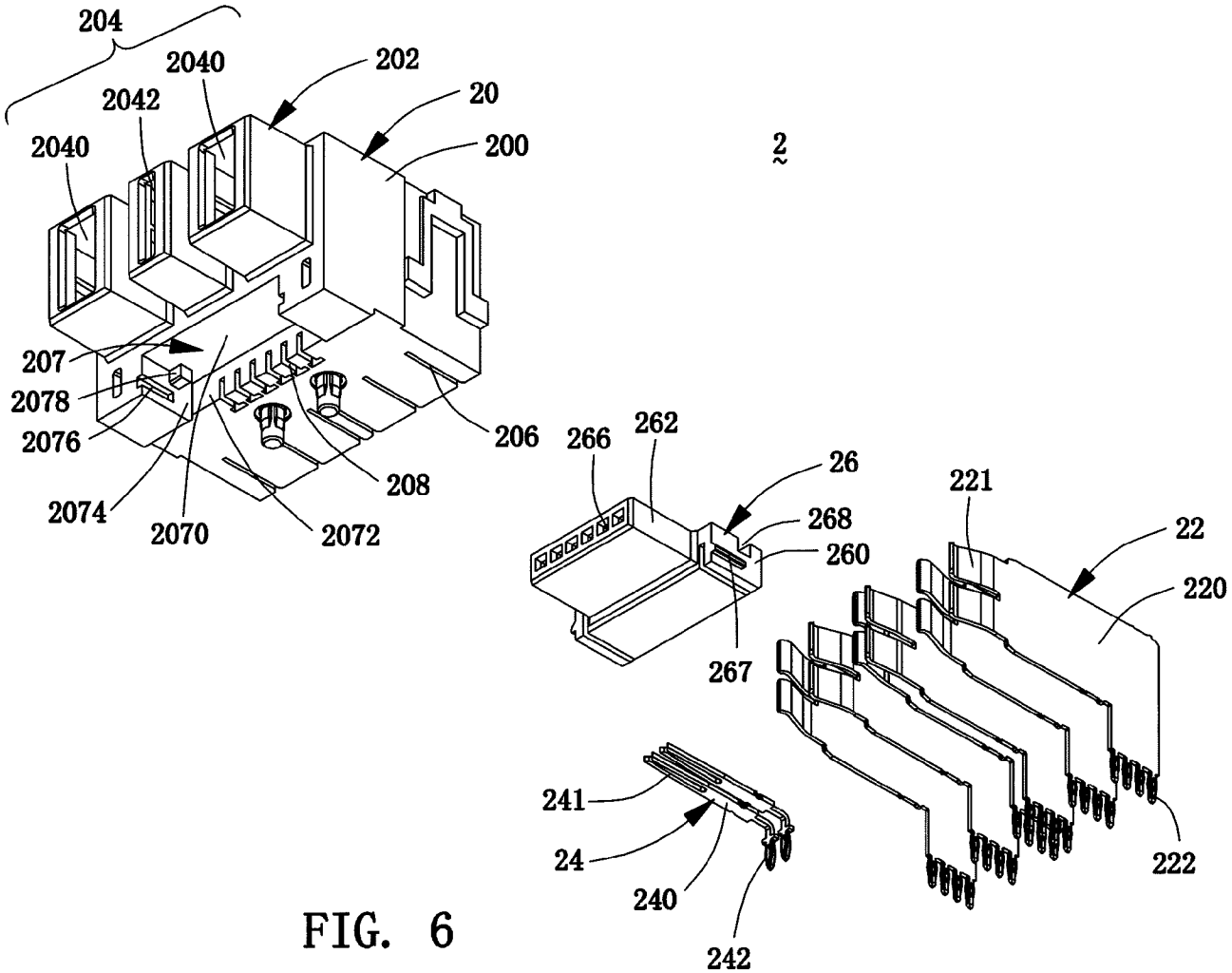
FIG. 6 is an exploded view of the receptacle connector shown in FIG. 5.
Figure 7:
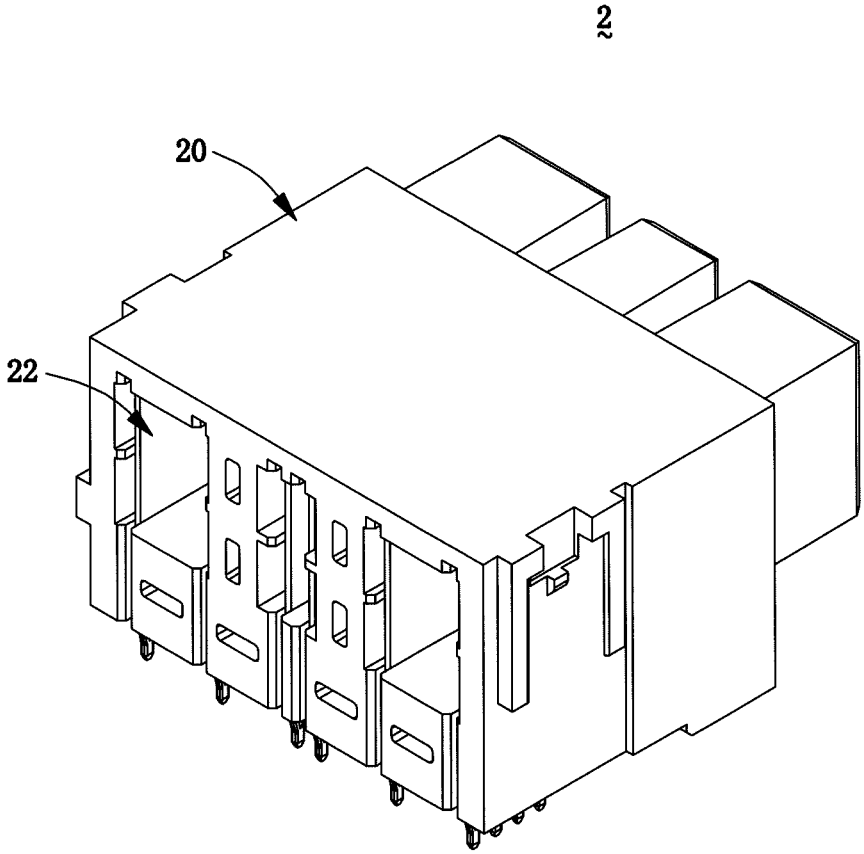
FIG. 7 is a perspective schematic view of the receptacle connector of the present invention along another direction.

As shown in FIG. 6, the receptacle power housing 20 includes a power base 200 and a row of vertical power mating bodies 202. The power mating bodies 202 are in parallel and protrude forward from a front surface of the power base 200 to form a row of vertical receptacle power ports 204, which extend backward to the power base 200.

In the embodiment, the receptacle power ports 204 have different structures. The receptacle power ports 204 include a first receptacle power port 2040 and a second receptacle power port 2042, and the width of the first receptacle power port 2040 is larger than that of the second receptacle power port 2042. In the embodiment, the number of the receptacle power ports 204 is three, including two receptacle power ports 2040 and one second receptacle power port 2042. The two receptacle power ports 2040 are symmetrically located at two sides of the second receptacle power port 2042. In other embodiments, the widths of the receptacle power ports 204 may be adjusted according to the need. For example, the width of the first receptacle power port 2040 may be less than or equal to that of the second receptacle power port 2042.

Figure 8:
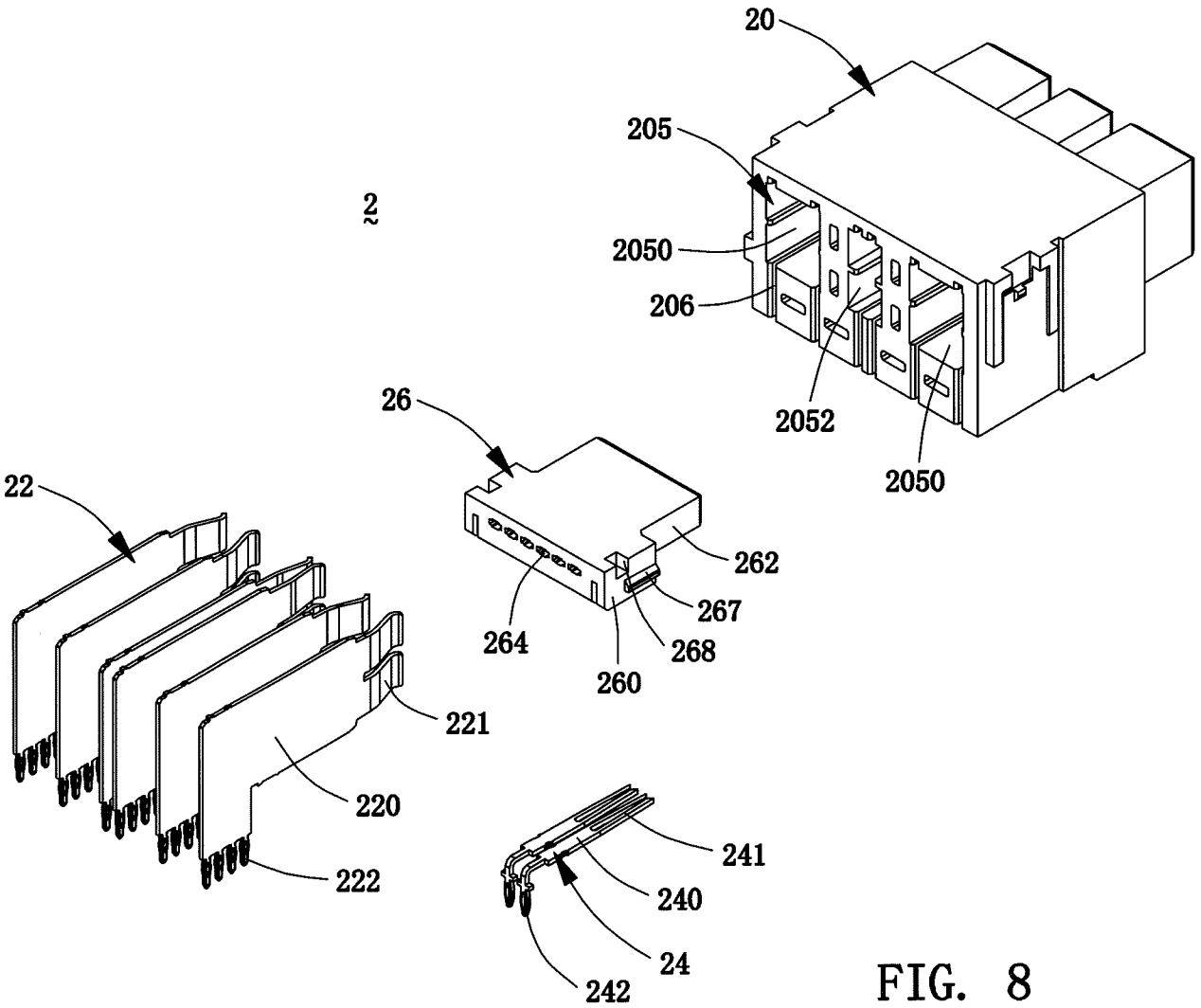
FIG. 8 is an exploded view of the receptacle connector shown in FIG. 7.

As shown in FIG. 8, a rear surface of the power base 200 forms a row of receptacle power contact-mounting cavities 205 including a first receptacle power contact-mounting cavity 2050 and a second power contact-mounting cavity 2052. The width of the first receptacle power contact-mounting cavity 2050 is larger than that of the second receptacle power contact-mounting cavity 2052. In the embodiment, two first receptacle power contact-mounting cavities 2050 are symmetrically located at two sides of the second receptacle power contact-mounting cavity 2052. Each of the receptacle power contact-mounting cavities 205 forms two receptacle power contact-receiving passages 206, which pass through the rear surface and a bottom surface of the power base 200 for being used to receive and fix the receptacle power contacts 22. The receptacle power contact-receiving passages 206 located in the first and second power contact-mounting cavities 2050, 2052 are respectively communicated with the corresponding first and second receptacle power ports 2040, 2042 shown in FIG. 6.

Moreover, the distance between the two receptacle power contact-receiving passages 206 located in the first receptacle power contact-mounting cavity 2050 is larger than that between other two receptacle power contact-receiving passages 206 located in the second receptacle power contact-mounting cavity 2052. In the embodiment, the number of the receptacle power contact-receiving passages 206 is six. In other embodiments, the distance between two receptacle power contact-receiving passages 206 located in one same receptacle power contact-mounting cavity 205 may be adjusted according to the need.

Please refer to FIG. 6, the power base 200 forms a concave space 207 on the bottom surface thereof. The concave space 207 has a top wall 2070, a rear wall 2072 and two opposite side walls 2074. Each side wall 2074 forms a slot 2076 and a convex block 2078. The rear wall 2072 forms a row of receptacle signal contact-receiving passages 208, which pass through the bottom surface of the power base 200 for receiving and fixing the receptacle signal contacts 24. In the embodiment, the number of the receptacle signal contact-receiving passages 208 is six. Of course, the numbers of the receptacle power contact-receiving passages 206 and the receptacle signal contact-receiving passages 208 cannot be used to limit the protection scope of the present invention.

Please refer to FIGS. 6 and 8, the receptacle signal housing 26 includes a flat signal base 260 and a flat horizontal signal mating body 262. The signal mating body 262 horizontally protrudes forward from a front surface of the signal base 260. The signal base 260 forms a row of signal holes 264, which pass through the front surface and a rear surface of the signal base 260 for receiving the receptacle signal contacts 24. A front surface of the signal mating body 262 forms a row of receptacle signal ports 266, which extend backward to the signal base 260 and are respectively communicated with the corresponding signal holes 264. In the embodiment, the numbers of the receptacle signal ports 266 and the signal holes 264 are six.

Moreover, as shown in FIGS. 6 and 8, the signal base 260 also forms a flange 267 corresponding to the slot 2076 of the power base 200 and a recess 268 corresponding to the convex block 2078 of the power base 200 on each of two opposite side surfaces of the signal base 260.

Figure 5:
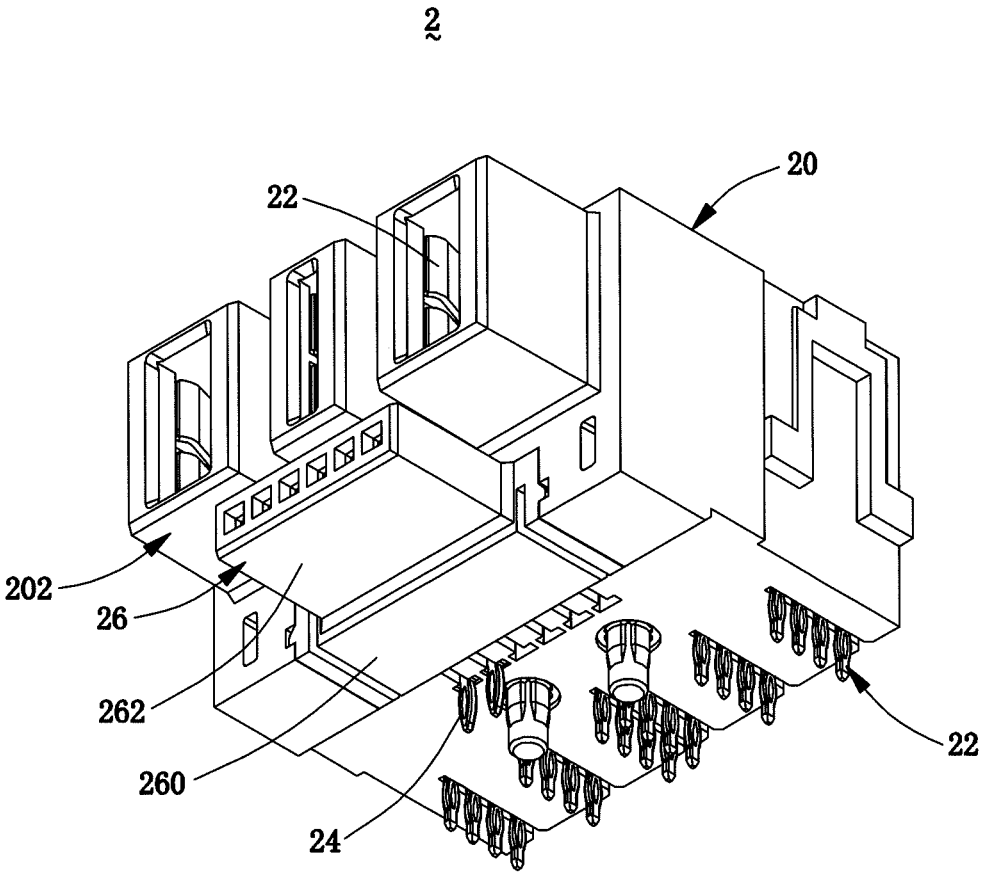
FIG. 5 is a perspective schematic view of a receptacle connector of the present invention.

Please refer to FIGS. 5 and 6, when the receptacle signal housing 26 is mounted on the receptacle power housing 20, the signal base 260 can be just embedded into the concave space 207 of the power base 200. Wherein the flange 267 is engaged with the slot 2076, and the convex block 2078 is engaged with the recess 268. Moreover, the signal holes 264 of the signal base 260 are connected and communicated with the receptacle signal contact-receiving passages 208 of the power base 200, thereby commonly securing the receptacle signal contacts 24. In the present invention, the signal mating body 262 of the receptacle signal housing 26 and the power mating bodies 202 of the receptacle power housing 20 form a stacked structure. Namely, the receptacle signal housing 26 is stacked under and fixed on the receptacle power housing 20.

Please refer to FIGS. 6 and 8, the row of the receptacle power contacts 22 includes six receptacle power contacts 22. Each two adjacent receptacle power contacts 22 have symmetrical structures and form a group. Each group is fixed in one receptacle power contact-mounting cavity 205, and each receptacle power contact 22 is mounted in the corresponding receptacle power contact-receiving passage 206 of the receptacle power housing 20. The receptacle power contact 22 includes an L type vertical plate 220, at least one elastic piece 221 being bent from a front edge of the vertical plate 220 and extending forward, and a tail portion 222 vertically extending downward from a bottom edge of the vertical plate 220. The elastic pieces 221 of two receptacle power contacts 22 in one group are symmetrical and form a clamp shape to commonly clamp the corresponding plug power contact 12. In the embodiment, each receptacle power contact 22 disposes two elastic pieces 221 having the same structures and being arranged along an upper and lower direction.

As shown in FIG. 6, when the receptacle power contacts are mounted in the receptacle power housing 20, the elastic pieces 221 of two receptacle power contacts 22 in each group pass through the corresponding receptacle power contact-receiving passages 206 to be inserted into one corresponding receptacle power port 204 and be respectively close to a left and right inner sidewalls of the receptacle power port 204, thereby preparing to be engaged with the corresponding plug power contact 12 of the plug connector 1. Wherein the vertical plate 220 of each receptacle power contact 22 is fixed in the corresponding receptacle power contact-receiving passage 206, and the tail portion 222 extends out of the bottom surface of the power base 200.

In the embodiment, the tail portion 222 of the receptacle power contact 22 consists of a row of needle eye-shaped pins, which can be pressed into conductive holes of the second circuit board 4 and be electrically connected with power points of the second circuit board 4.

Please refer to FIG. 6, the row of the receptacle signal contacts 24 includes two receptacle signal contacts 24. Each receptacle signal contact 24 is mounted in the corresponding receptacle signal contact-receiving passage 208 of the receptacle signal housing 26. The receptacle signal contact 24 includes a horizontal plate 240, a forked head 241 horizontally extending forward from a front edge of the horizontal plate 240, and a tail end 242 being bent downward from a rear edge of the horizontal plate 240. Wherein the horizontal plate 240 is fixed in the corresponding signal hole 264 of the receptacle signal housing 26, the forked head 241 enters into the corresponding receptacle signal port 266 for preparing to mate with the plug signal contact 14 of the plug connector 1, and the tail end 242 extends along the corresponding receptacle signal contact-receiving passage 208 and extends out of the bottom surface of the power base 200 for preparing to be connected with the second circuit board 4.

In the embodiment, the tail end 242 of each receptacle signal contact 24 is a needle eye-shaped pin.

Please refer to FIG. 9, an electrical connector assembly 5 of the present invention includes the plug connector 1 in parallel mounted on the first circuit board 3 and the receptacle connector 2 in parallel mounted on the second circuit board 4. The plug connector 1 is disclosed in FIGS. 1 to 4, and the receptacle connector 2 is disclosed in FIGS. 5 to 8. When the plug connector 1 is mated with the receptacle connector 2, the power mating bodies 202 and the signal mating body 262 of the receptacle connector 2 are respectively inserted into the corresponding plug power ports 102 and the plug signal port 103 of the plug connector 1, and the plug power contacts 12 and the plug signal contacts 14 are respectively inserted into the receptacle power ports 204 and the receptacle signal ports 266. Specifically, the mating ends 120 of two plug power contacts 12 located in the first plug power port 2012 can enter into the corresponding first receptacle power port 2040 and be inserted between the elastic pieces 221 of two receptacle power contacts 22 to electrically contact with the elastic pieces 221. Further, the head 140 of the plug signal contact 14 can enter into the corresponding receptacle signal port 266 and be electrically engaged with the forked head 241 of the corresponding receptacle signal contact 24. By this connection way, the plug power contact 12 and the plug signal contact 14 are respectively and electrically connected with the receptacle power contact 22 and the receptacle signal contact 24.

As described above, the power ports 102, 204 and the signal ports 103, 266 in the present invention are disposed to be a stacked structure. Therefore, the plug connector 1 and the receptacle connector 2 of the present invention form more compact structures, and can save edge space of the circuit boards 3 and 4. Further, more other type connectors can be mounted on the edge of the circuit boards 3 and 4. Moreover, the plug power contacts 12 and the receptacle power contacts 22 are respectively mounted in a plug housing 10 and a receptacle power housing 20 according to a special arrangement, such as different distance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector, comprising a plug housing, a plug retaining seat, a row of plug power contacts and a row of plug signal contacts; wherein the plug housing having a mating portion located on the front of the plug housing and a mounting portion located on the rear thereof, a front surface of the mating portion being perpendicular to a bottom surface of the mounting portion, a front surface of the mating portion forming a row of parallel vertical plug power ports and one plug signal port located under the row of the plug power ports to form a stacked structure, the row of the plug power ports including at least one first plug power port and at least one second plug power port, the first plug power port forming a vertical middle plate therein, the plug signal port having an open bottom and having a top wall and two opposite sidewalls, the mounting portion forming a row of plug power contact-mounting cavities that include at least one first plug power contact-mounting cavity and at least one second plug power contact-mounting cavity, each of the plug power contact-mounting cavities forming two plug power contact-receiving passages that pass through a rear surface and the bottom surface of the mounting portion to receive and fix the plug power contacts, the plug power contact-receiving passages located in the first and second plug power contact-mounting cavity being respectively communicated with the first and second plug power ports; the mounting portion further forming a row of plug signal contact-receiving passages that are located on the bottom surface of the mounting portion and communicated with the plug signal port to receive the corresponding plug signal contacts;

the plug retaining seat being drawer-shaped and having a bottom board, two opposite side boards and a rear board; the plug retaining seat being mounted on the mating portion of the plug housing to close the open bottom of the plug signal port and fix the plug signal contacts;

each two adjacent plug power contacts having symmetrical structures and forming a group, each group being fixed in one plug power contact-mounting cavity, and each plug power contact being fixed in the corresponding plug power contact-receiving passage; each of the plug power contacts including an L-type connecting portion being vertical and blade-shaped, a vertical blade-shaped mating end being bent toward one side from a front end of the connecting portion and then horizontally extending forward, and a back end vertically extending downward from a bottom end of the connecting portion; wherein the mating end passes through the corresponding plug power contact-receiving passage to enter into the corresponding plug power port, the connecting portion is fixed in the plug power contact-receiving passage, and the back end extends out of the bottom surface of the mounting portion; and each of the plug signal contacts including a head horizontally extending forward, a tail being perpendicular to the head and vertically extending downward, and an L type retaining portion connecting the head and the tail; wherein the head is inserted into the plug signal port, one portion of the L type retaining portion is fixed in the plug signal contact-receiving passage, the other portion thereof is fixed in the plug retaining seat, and the tail extends out of the bottom surface of the mounting portion.

2. The plug connector as claimed in claim 1, wherein the row of the plug power ports includes two first plug power ports and one second plug power port, the width of the first plug power port is larger than that of the second plug power port, the two first plug power ports are symmetrically located at two sides of the second plug power port, the row of the plug power contact-mounting cavities includes two first plug power contact-mounting cavities and one second plug power contact-mounting cavity, the width of the first plug power contact-mounting cavity is larger than that of the second plug power contact-mounting cavity, and the two first plug power contact-mounting cavities are symmetrically located at two sides of the second plug power contact-mounting cavity.

3. The plug connector as claimed in claim 2, wherein the distance between two plug power contact-receiving passages located in the first plug power contact-mounting cavity is larger than that between other two plug power contact-receiving passages located in the second plug power contact-mounting cavity, two mating ends of the plug power contacts located in the first plug power contact-mounting cavity respectively pass through the corresponding plug power contact-receiving passages to enter into the first plug power port and be respectively located close to two sides of the middle plate, and two mating ends of the plug power contacts located in the second plug power contact-mounting cavity respectively pass through the corresponding plug power contact-receiving passages to enter into the second plug power port and be tightly close to each other.

4. The plug connector as claimed in claim 3, wherein each of the two sidewalls of the plug signal port forms a groove and a protrusion, an outside surface of each side board of the plug retaining seat has a rib corresponding to the groove, and each side board also has a notch corresponding to the protrusion.

5. The plug connector as claimed in claim 4, wherein the rear board of the plug retaining seat forms a row of through holes passing through a front and rear surfaces thereof, the retaining portion of the plug signal contact has a horizontal width portion in a horizontal direction and a vertical width portion in a vertical direction, the head of the plug signal contact passes through the through hole of the plug retaining seat and is inserted into the plug signal port, the horizontal width portion is fixed in the through hole, and the vertical width portion is fixed in the plug signal contact-receiving passage.

6. A receptacle connector, comprising a receptacle power housing, a receptacle signal housing, a row of receptacle power contacts and a row of receptacle signal contacts; wherein the receptacle power housing including a power base and a row of parallel vertical power mating bodies, the row of the power mating bodies being in parallel and protruding forward from a front surface of the power base to form a row of vertical receptacle power ports, the row of the receptacle power ports including at least one first receptacle power port and at least one second receptacle power port; a rear surface of the power base forming a row of receptacle power contact-mounting cavities that include at least one first receptacle power contact-mounting cavity and at least one second power contact-mounting cavity, each of the receptacle power contact-mounting cavities forming two receptacle power contact-receiving passages that pass through the rear surface and a bottom surface of the power base to receive and fix the corresponding receptacle power contacts; the power base forming a concave space on the bottom surface thereof, the concave space having a top wall, a rear wall and two opposite side walls; the rear wall forming a row of receptacle signal contact-receiving passages that pass through the bottom surface of the power base to receive and fix the receptacle signal contacts;

the receptacle signal housing including a flat signal base and a flat horizontal signal mating body, the signal mating body horizontally protruding forward from a front surface of the signal base; the signal base being embedded into the concave space of the power base, the signal mating body being located under the power mating bodies; the signal base forming a row of signal holes to receive the receptacle signal contacts, a front surface of the signal mating body forming a row of receptacle signal ports that extend backward to the signal base and are respectively communicated with the corresponding signal holes;

each two adjacent receptacle power contacts having symmetrical structures and forming a group, each group being fixed in one receptacle power contact-mounting cavity, and each receptacle power contact being mounted in the corresponding receptacle power contact-receiving passage; each receptacle power contact including an L type vertical plate, at least one elastic piece being bent from a front edge of the vertical plate and extending forward, and a tail portion vertically extending downward from a bottom edge of the vertical plate; the vertical plate being fixed in the corresponding receptacle power contact-receiving passage, the elastic piece being inserted into the corresponding receptacle power port, and the tail portion extending out of the bottom surface of the power base; and each receptacle signal contact including a horizontal plate, a forked head horizontally extending forward from a front edge of the horizontal plate, and a tail end being bent downward from a rear edge of the horizontal plate; the horizontal plate being fixed in the corresponding signal hole, the forked head entering into the corresponding receptacle signal port, and the tail end extending along the corresponding receptacle signal contact-receiving passage and extending out of the bottom surface of the power base.

7. The receptacle connector as claimed in claim 6, wherein the row of the receptacle power ports includes two first receptacle power ports and one second receptacle power port, the width of the first receptacle power port is larger than that of the second receptacle power port, the two first receptacle power ports are symmetrically located at two sides of the second receptacle power port; the row of the receptacle power contact-mounting cavities includes two first receptacle power contact-mounting cavities and one second receptacle power contact-mounting cavity, the width of the first receptacle power contact-mounting cavity is larger than that of the second receptacle power contact-mounting cavity, and the two first receptacle power contact-mounting cavities are symmetrically located at two sides of the second receptacle power contact-mounting cavity; the distance between two receptacle power contact-receiving passages located in the first receptacle power contact-mounting cavity is larger than that between other two receptacle power contact-receiving passages located in the second receptacle power contact-mounting cavity.

8. The receptacle connector as claimed in claim 6, wherein the elastic pieces of two receptacle power contacts in each group pass through the corresponding receptacle power contact-receiving passages to enter into one corresponding receptacle power port and respectively close to a left and right inner sidewalls of the receptacle power port.

9. The receptacle connector as claimed in claim 6, wherein each side wall of the concave space forms a slot and a convex block, each of two opposite side surfaces of the signal base forms a flange corresponding to the slot and a recess corresponding to the convex block.

10. An electrical connector assembly, comprising:

a plug connector comprising a plug housing, a plug retaining seat, a row of plug power contacts and a row of plug signal contacts; wherein the plug housing having a mating portion located on the front of the plug housing and a mounting portion located on the rear thereof, a front surface of the mating portion being perpendicular to a bottom surface of the mounting portion, a front surface of the mating portion forming a row of parallel vertical plug power ports and one plug signal port located under the row of the plug power ports to form a stacked structure, the row of the plug power ports including at least one first plug power port and at least one second plug power port, the first plug power port forming a vertical middle plate therein, the plug signal port having an open bottom and having a top wall and two opposite sidewalls, the mounting portion forming a row of plug power contact-mounting cavities that include at least one first plug power contact-mounting cavity and at least one second plug power contact-mounting cavity, each of the plug power contact-mounting cavities forming two plug power contact-receiving passages that pass through a rear surface and the bottom surface of the mounting portion to receive and fix the plug power contacts, the plug power contact-receiving passages located in the first and second plug power contact-mounting cavity being respectively communicated with the first and second plug power ports; the mounting portion further forming a row of plug signal contact-receiving passages that are located on the bottom surface of the mounting portion and communicated with the plug signal port to receive the corresponding plug signal contacts;

the plug retaining seat being drawer-shaped and having a bottom board, two opposite side boards and a rear board; the plug retaining seat being mounted on the mating portion of the plug housing to close the open bottom of the plug signal port and fix the plug signal contacts;

each two adjacent plug power contacts having symmetrical structures and forming a group, each group being fixed in one plug power contact-mounting cavity, and each plug power contact being fixed in the corresponding plug power contact-receiving passage; each of the plug power contacts including an L-type connecting portion being vertical and blade-shaped, a vertical blade-shaped mating end being bent toward one side from a front end of the connecting portion and then horizontally extending forward, and a back end vertically extending downward from a bottom end of the connecting portion; wherein the mating end passes through the corresponding plug power contact-receiving passage to enter into the corresponding plug power port, the connecting portion is fixed in the plug power contact-receiving passage, and the back end extends out of the bottom surface of the mounting portion; and each of the plug signal contacts including a head horizontally extending forward, a tail being perpendicular to the head and vertically extending downward, and an L type retaining portion connecting the head and the tail;

wherein the head is inserted into the plug signal port, one portion of the L type retaining portion is fixed in the plug signal contact-receiving passage, the other portion thereof is fixed in the plug retaining seat, and the tail extends out of the bottom surface of the mounting portion; and a receptacle connector comprising a receptacle power housing, a receptacle signal housing, a row of receptacle power contacts and a row of receptacle signal contacts; wherein the receptacle power housing including a power base and a row of parallel vertical power mating bodies, the row of the power mating bodies being in parallel and protruding forward from a front surface of the power base to form a row of vertical receptacle power ports, the row of the receptacle power ports including at least one first receptacle power port and at least one second receptacle power port; a rear surface of the power base forming a row of receptacle power contact-mounting cavities that include at least one first receptacle power contact-mounting cavity and at least one second power contact-mounting cavity, each of the receptacle power contact-mounting cavities forming two receptacle power contact-receiving passages that pass through the rear surface and a bottom surface of the power base to receive and fix the corresponding receptacle power contacts; the power base forming a concave space on the bottom surface thereof, the concave space having a top wall, a rear wall and two opposite side walls; the rear wall forming a row of receptacle signal contact-receiving passages that pass through the bottom surface of the power base to receive and fix the receptacle signal contacts;

the receptacle signal housing including a flat signal base and a flat horizontal signal mating body, the signal mating body horizontally protruding forward from a front surface of the signal base; the signal base being embedded into the concave space of the power base, the signal mating body being located under the power mating bodies; the signal base forming a row of signal holes to receive the receptacle signal contacts, a front surface of the signal mating body forming a row of receptacle signal ports that extend backward to the signal base and are respectively communicated with the corresponding signal holes;

each two adjacent receptacle power contacts having symmetrical structures and forming a group, each group being fixed in one receptacle power contact-mounting cavity, and each receptacle power contact being mounted in the corresponding receptacle power contact-receiving passage; each receptacle power contact including an L type vertical plate, at least one elastic piece being bent from a front edge of the vertical plate and extending forward, and a tail portion vertically extending downward from a bottom edge of the vertical plate; the vertical plate being fixed in the corresponding receptacle power contact-receiving passage, the elastic piece being inserted into the corresponding receptacle power port, and the tail portion extending out of the bottom surface of the power base; and each receptacle signal contact including a horizontal plate, a forked head horizontally extending forward from a front edge of the horizontal plate, and a tail end being bent downward from a rear edge of the horizontal plate; the horizontal plate being fixed in the corresponding signal hole, the forked head entering into the corresponding receptacle signal port, and the tail end extending along the corresponding receptacle signal contact-receiving passage and extending out of the bottom surface of the power base;

wherein when the plug connector is engaged with the receptacle connector, the power mating bodies and the signal mating body of the receptacle connector respectively entering into the corresponding plug power ports and the plug signal port of the plug connector, the plug power contacts and the plug signal contacts respectively entering into the receptacle power ports and the receptacle signal ports, the vertical blade-shaped mating end of the plug power contact being inserted between the elastic pieces of the corresponding two receptacle power contacts, and the head of the plug signal contact being inserted into the forked head of the corresponding receptacle signal contact.

* * * * *